US009585495B2

(12) United States Patent
Gottsleben

(10) Patent No.: US 9,585,495 B2
(45) Date of Patent: Mar. 7, 2017

(54) BUILT-IN MOBILE ARM FOR A CRIB

(71) Applicant: Richard Gottsleben, San Diego, CA (US)

(72) Inventor: Richard Gottsleben, San Diego, CA (US)

( * ) Notice: Subject to any disclaimer, the term of this patent is extended or adjusted under 35 U.S.C. 154(b) by 0 days.

(21) Appl. No.: 14/842,143

(22) Filed: Sep. 1, 2015

(65) Prior Publication Data

US 2016/0066709 A1 Mar. 10, 2016

Related U.S. Application Data

(60) Provisional application No. 62/046,225, filed on Sep. 5, 2014.

(51) Int. Cl.
*A47D 15/00* (2006.01)
*A63H 33/00* (2006.01)

(52) U.S. Cl.
CPC ..... *A47D 15/00* (2013.01); *A63H 33/006* (2013.01)

(58) Field of Classification Search
CPC . A47D 7/00; A47D 9/00; A47D 13/06; A47D 15/00; A47C 21/00; A47C 31/00; A63H 33/006; A63H 33/00
USPC ..... 5/93.1, 93.2, 655, 503.1, 658; 446/227
See application file for complete search history.

(56) References Cited

U.S. PATENT DOCUMENTS 3,978,610 A 9/1976 Stubbmann
5,352,145 A 10/1994 Raiffe et al.
5,370,570 A * 12/1994 Harris ..... A63H 33/006 24/486
6,447,362 B2 9/2002 Khamphilavong et al.
6,464,555 B1 10/2002 Paduano
7,172,486 B2 * 2/2007 Drosendahl ..... A63H 33/006 446/175
7,337,479 B2 * 3/2008 Van Huystee ..... A47D 15/00 446/227
7,476,142 B2 * 1/2009 Mastrosimone-Gese ..... A63H 33/006 446/227
7,762,865 B2 * 7/2010 Gelfond ..... A63H 33/006 446/227
8,997,277 B2 * 4/2015 Thomas ..... A47D 5/00 5/414
2002/0104161 A1 * 8/2002 Kuo ..... A47D 13/06 5/93.1

(Continued)

*Primary Examiner* — Robert G Santos
(74) *Attorney, Agent, or Firm* — Global Intellectual Property Agency, LLC; Daniel Boudwin

(57) ABSTRACT

A built-in mobile arm for a crib for storing and using a mobile arm secured to a crib. The built-in mobile arm includes a crib having base, one or more sidewalls, and an open upper end, defining an interior volume. The device further includes a mobile arm having a first end, a second end, and one or more members, wherein a first member is pivotally secured to a second member so as to allow the arm to fold into a stored configuration. The second end of the mobile arm is adjustably secured to the crib, whereas the first end is able to support a mobile thereon. The crib further includes a recessed area disposed on a sidewall that receives the arm therein for storing. In an alternate embodiment, the recessed area is disposed in a leg of the crib, wherein the mobile arm can retract therein or extend upwards therefrom.

7 Claims, 4 Drawing Sheets

(56) References Cited

U.S. PATENT DOCUMENTS

2003/0064818 A1* 4/2003 Drosendahl ..... A63H 33/006 472/118
2005/0197040 A1 9/2005 Babbidge et al.
2005/0198733 A1* 9/2005 Van Huystee ..... A63H 33/006 5/93.1
2006/0199468 A1* 9/2006 Mastrosimone-Gese ..... A63H 33/006 446/227
2008/0176480 A1* 7/2008 Gelfond ..... A63H 33/006 446/227
2009/0209169 A1* 8/2009 Curry ..... A47D 9/00 446/227
2010/0162484 A1* 7/2010 Thomas ..... A47D 5/00 5/93.2
2011/0230115 A1* 9/2011 Wang ..... A63H 33/006 446/227
2016/0066709 A1* 3/2016 Gottsleben ..... A63H 33/006 5/93.1

* cited by examiner

BUILT-IN MOBILE ARM FOR A CRIB

CROSS REFERENCE TO RELATED APPLICATION

This application claims the benefit of U.S. Provisional Application No. 62/046,225 filed on Sep. 5, 2014. The above identified patent application is herein incorporated by reference in its entirety to provide continuity of disclosure.

BACKGROUND OF THE INVENTION

Field of the Invention

The present invention relates to mobile arm devices. More specifically, the present invention provides a built-in mobile arm for a crib comprising a crib and a mobile arm, wherein a second end of the mobile arm is adjustably secured to the crib and a first end of the mobile arm is configured to support a mobile therefrom. The crib comprises a recessed area configured to receive and store the mobile arm therein.

Many parents and caretakers rely on mobiles that play music and comprise various rotating toys in order to entertain and soothe children while they lie in a crib. These mobiles, however, must be secured to a crib if they are to hang directly above an infant or small child. There is a safety concern in placing a detachable mobile arm to a crib due to the risk of the mobile arm becoming detached and falling on the child or causing a child to choke on the small components hanging from the mobile.

Further, finding a storage place for a mobile arm while not in immediate use is inconvenient due to the awkward shape of the arm. Some individuals choose to allow the mobile arm to remain attached to the crib while not in use. However, a child can stand in the crib and easily detach or break the mobile arm or mobile by pulling thereon. Once a child no longer requires a crib, the mobile arm needs to be stored or disposed of and finding separate locations to store both the crib and the mobile arm is inconvenient. Therefore, there exists a need in the prior art for a crib having a built-in mobile arm that can support a music playing device or mobile thereon.

Devices have been disclosed in the prior art that relate to mobile arm devices. These include devices that have been patented and published in patent application publications. These devices generally relate to elongated arms, wherein an end of the arm is configured to hang a mobile thereon, such as U.S. Pat. No. 6,447,362, U.S. Patent Application Publication Number 2005/0197040, U.S. Pat. No. 6,464,555, U.S. Pat. No. 5,352,145, and U.S. Pat. No. 3,978,610.

These prior art devices have several known drawbacks. Some of the prior art devices are adjustable in length and comprise a cantilever construction capable of holding a mobile on an end thereof. However, the prior art fails to disclose an elongated arm capable of folding for storage, wherein the arm is permanently secured to a crib. Further, the devices fail to comprise a crib having a recessed area adapted to receive a mobile arm therein.

In light of the devices disclosed in the prior art, it is submitted that the present invention substantially diverges in design elements from the prior art and consequently it is clear that there is a need in the art for an improvement to existing mobile arm devices. In this regard the instant invention substantially fulfills these needs.

SUMMARY OF THE INVENTION

In view of the foregoing disadvantages inherent in the known types of mobile arm devices now present in the prior art, the present invention provides a new mobile arm device wherein the same can be utilized for providing convenience for the user when storing and using a mobile arm to hang a mobile thereon.

It is therefore an object of the present invention to provide a new and improved built-in mobile arm for a crib that has all of the advantages of the prior art and none of the disadvantages.

It is another object of the present invention to provide a built-in mobile arm for a crib comprising a crib having a base, one or more sidewalls, and an open upper end, defining an interior volume adapted to receive one or more children therein.

Another object of the present invention is to provide a built-in mobile arm for a crib further comprising a mobile arm having a first end, a second end, and one or more elongated members, wherein a first member is pivotally secured to a second member.

Yet another object of the present invention is to provide a built-in mobile arm for a crib wherein the first end of the mobile arm is configured to support a mobile therefrom and the second end of the mobile arm is adjustably secured to the crib.

Yet another object of the present invention is to provide a built-in mobile arm for a crib wherein the first and second elongated members of the mobile arm are foldable so as to allow the arm to fold into a stored configuration.

Yet another object of the present invention is to provide a built-in mobile arm for a crib wherein a recessed area is disposed on the crib and configured to receive the mobile arm therein for storing.

Yet another object of the present invention is to provide a built-in mobile arm for a crib further comprising, in an alternate embodiment of the crib, a spring having a first end secured to a lower end of the recessed area and a second end secured to the second end of the mobile arm, wherein the spring is configured to expand in order to push the mobile arm towards the open upper end of the crib and compress in order to allow the mobile arm to retract within the recessed area for storing.

Another object of the present invention is to provide a built-in mobile arm for a crib that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
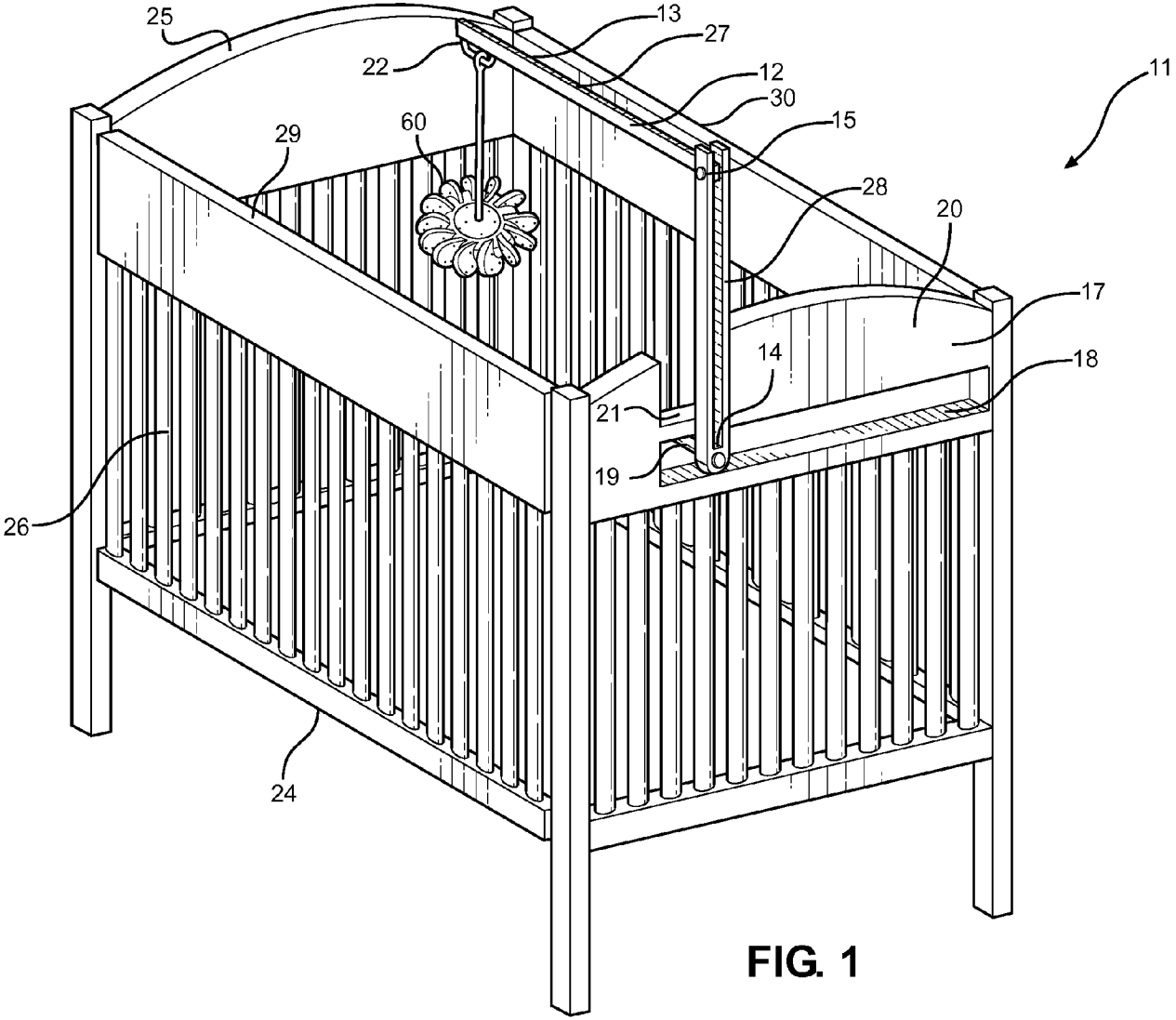
FIG. 1 shows a perspective view of the built-in mobile arm for a crib, wherein the mobile arm is in a working configuration.

Reference is made herein to the attached drawings. Like reference numerals are used throughout the drawings to depict like or similar elements of the built-in mobile arm for a crib. For the purposes of presenting a brief and clear description of the present invention, the preferred embodiment will be discussed as used for storing and using a mobile arm secured to a crib. The figures are intended for representative purposes only and should not be considered to be limiting in any respect.

Referring now to FIG. 1, there is shown a perspective view of the built-in mobile arm for a crib, wherein the mobile arm is in a working configuration. The built-in mobile arm 11 comprises a crib 17 having a base 24, one or more sidewalls 20, and an open upper end 25, defining an interior volume adapted to receive one or more children therein. The device 11 further comprises a mobile arm 12 adjustably and rotatably secured to the crib 17, wherein the mobile arm 12 is movable between a working configuration and a stored configuration. In the working configuration, the movable arm 12 is extended above the open upper end 25 of the crib 17 and configured to support a mobile 60 thereon. In the stored configuration, the mobile arm 12 is positioned within a recessed area 18 disposed on the crib 17 for storing.

In the illustrated embodiment, the crib 17 comprises a rectangular cross section, however, in alternate embodiments the crib 17 can comprise any suitable cross section, such as an oval. One or more sidewalls 20 of the crib 17 comprise a plurality of vertically extended slats 26 disposed between the upper end 25 and base 24 thereof, wherein the sidewall 20 is open between the slats 26. In other embodiments, one or more sidewalls 20 may be configured in any suitable manner so as to form a barrier between the interior and the exterior of the crib 17, including solid sidewalls 20.

Preferably, the crib 17 further comprises a recessed area 18 disposed on the sidewall 20 on which the mobile arm 12 is attached. The recessed area 18 is adapted to receive the mobile arm 12 therein for storing. In the illustrated embodiment, the recessed area 18 is disposed on the exterior of the sidewall 20 of the crib 17 toward the upper end 25 thereof. In other embodiments, the recessed area 18 can be disposed on any suitable location of the crib 17. The recessed area 18 comprises a rectangular shape so as to correspond to the shape of the folded mobile arm 12. Alternatively, the recessed area 18 may comprise any suitable shape that corresponds to the shape of the mobile arm 12 configured to be disposed therein.

The mobile arm 12 comprises a first end 13 and a second end 14, wherein the first end 13 of the mobile arm 12 is configured to receive and support a mobile 60 thereon. The mobile 60 is used to entertain and soothe children that are in the crib 17 by playing music and providing visual stimulation. In the illustrated embodiment, the first end 13 of the mobile arm 12 comprises a fastener, such as a hook or ring 22, disposed thereon in order to receive and suspend the mobile 60 therefrom.

The second end 14 of the mobile arm 12 is adjustably and rotatably secured to the crib 17. In the illustrated embodiment, the second end 14 of the arm 12 is secured to a sidewall 20 of the crib 17 by any suitable fastener 19, including a nut and bolt or ball socket joint. The fastener 19 is configured to permit the second end 14 of the mobile arm 12 to tilt towards the interior of the crib 17 in order to adjust the positioning of the mobile 60 overhead. In some embodiments, a slot 21 is disposed along the upper end 25 of the crib 17 so as to receive a portion of the mobile arm 12 therethrough. Thus, the arm 12 is enabled to tilt further into the interior of the crib 17 without the obstruction of the crib 17. The fastener 19 further allows the mobile arm 12 to rotate from a first side 29 of the crib 17 to a second side 30 thereof, such that the arm 12 can be moved between a horizontal and vertical position. In the illustrated embodiment, the fastener 19 is adapted to move perpendicularly to the sidewall 20 of the crib 17. In this way, in operation, the mobile arm 12 can be placed within or removed from the recessed area 18.

The mobile arm 12 comprises one or more elongated members 27, 28. In the illustrated embodiment, a first elongated member 27 is pivotally secured to a second elongated member 28 so as to allow the mobile arm 12 to fold into a stored configuration. The first end 13 of the mobile arm 12 comprises the first elongated member 27 and the second end 14 of the mobile arm 12 comprises the second elongated member 28 that is secured to the crib 17. The elongated members 27, 28 are fastened to one another via any suitable fastener, such as a hinge 15. The hinge 15 permits the elongated members 27, 28 to pivot relative to one another, however, the elongated members 27, 28 remain in the disposed configuration until moved by a user. In the illustrated embodiment, each elongated member 27, 28 comprises a rectangular cross section, however, in other embodiments, the elongated members 27, 28 may comprise any suitable cross sectional shape. In some embodiments, the elongated members 27, 28 are telescoping so as to allow the mobile arm 12 to form a stored configuration.

In the illustrated embodiment, in the working configuration, the first elongated member 27 of the mobile arm 12 is horizontally extended such that the first end 13 of the mobile arm 12 is positioned over the upper end 25 and interior volume of the crib 17 so as to allow a mobile 60 to extend downward therefrom. The second elongated member 28 of the mobile arm 12 extends upwards from the crib 17 such that the second end 14 if the mobile arm 12 can be disposed at an angle or rotated towards the first or second side 29, 30 of the crib 17 in order to adjust the placement of the mobile 60.

Figure 2:
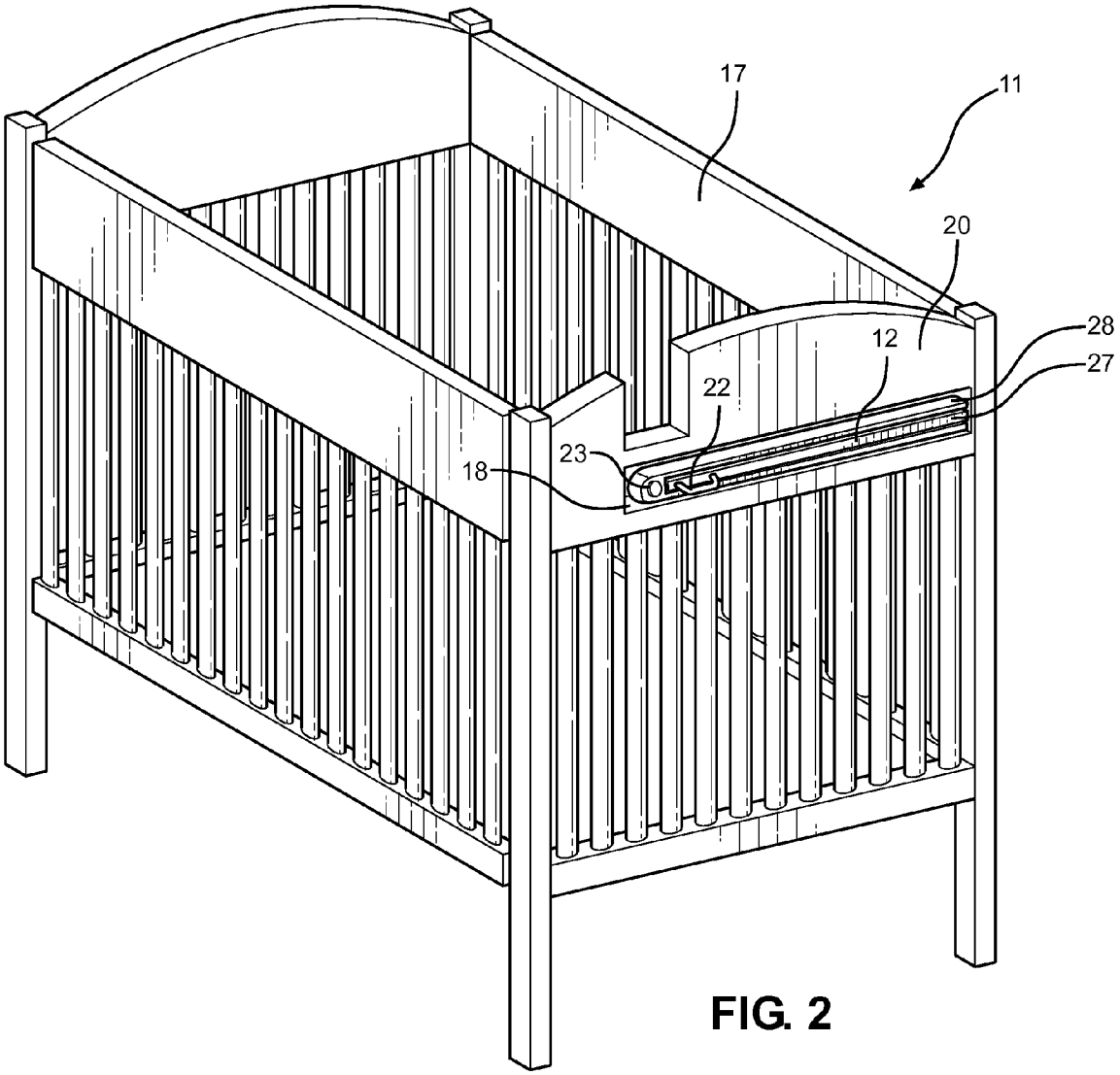
FIG. 2 shows a perspective view of the built-in mobile arm for a crib, wherein the mobile arm is in a stored configuration.

Referring now to FIG. 2, there is shown a perspective view of the built-in mobile arm for a crib, wherein the mobile arm is in a stored configuration. Preferably, in the stored configuration, the first elongated member 27 is folded parallel to the second elongated member 28 and the mobile arm 12 is disposed within the recessed area 18 of the crib 17. The folded mobile arm 12 is aligned substantially flush with the sidewall 20 of the crib 17 on which the recessed area 18 is disposed. The ring 22 may be used as a gripping surface, thus allowing an individual to pull the mobile arm 12 from the recessed area 18 and into the working configuration as desired.

Figure 3:
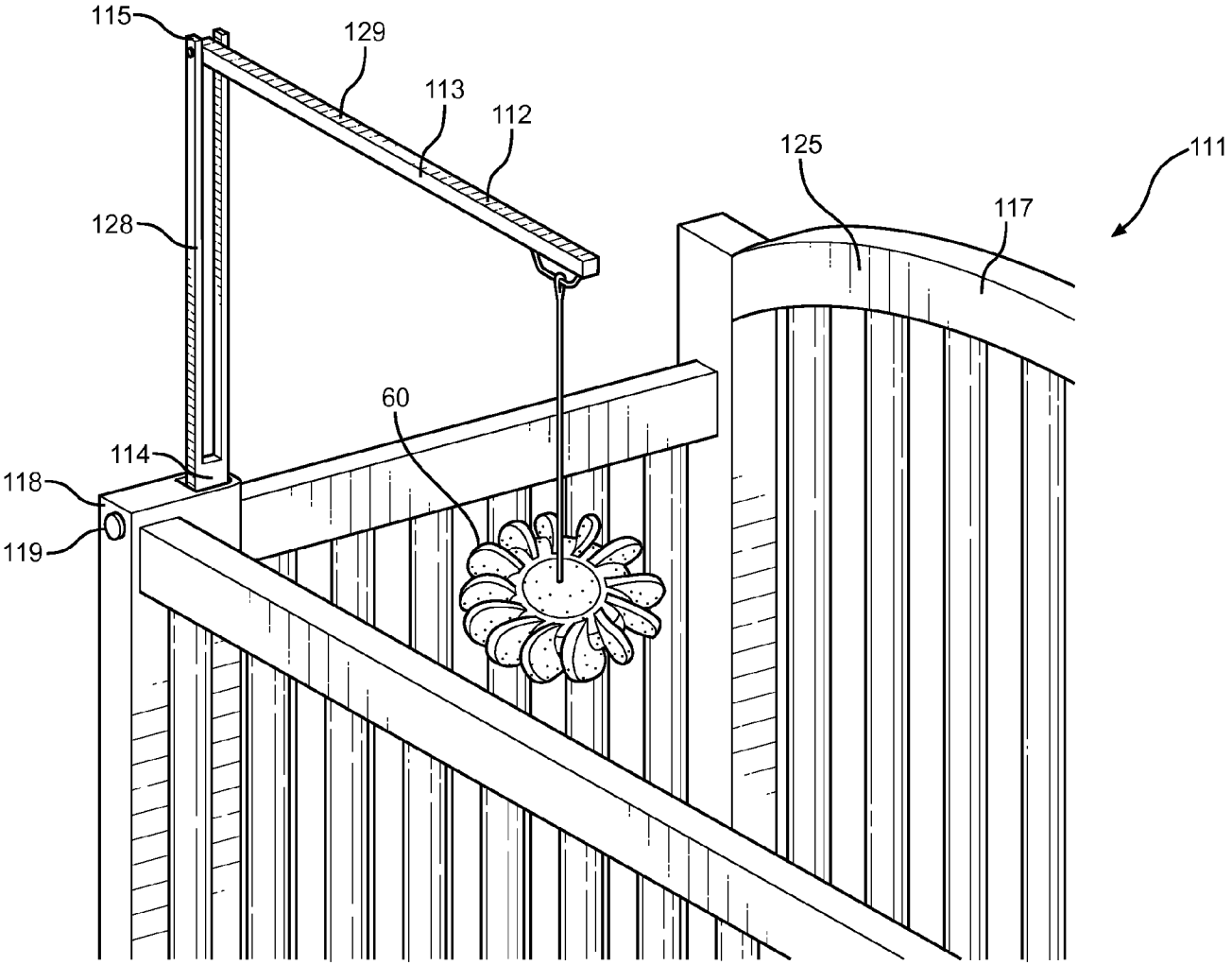
FIG. 3 shows a perspective view of an alternate embodiment of the crib of the built-in mobile arm for a crib, wherein the mobile arm is in a working configuration.
Figure 4:
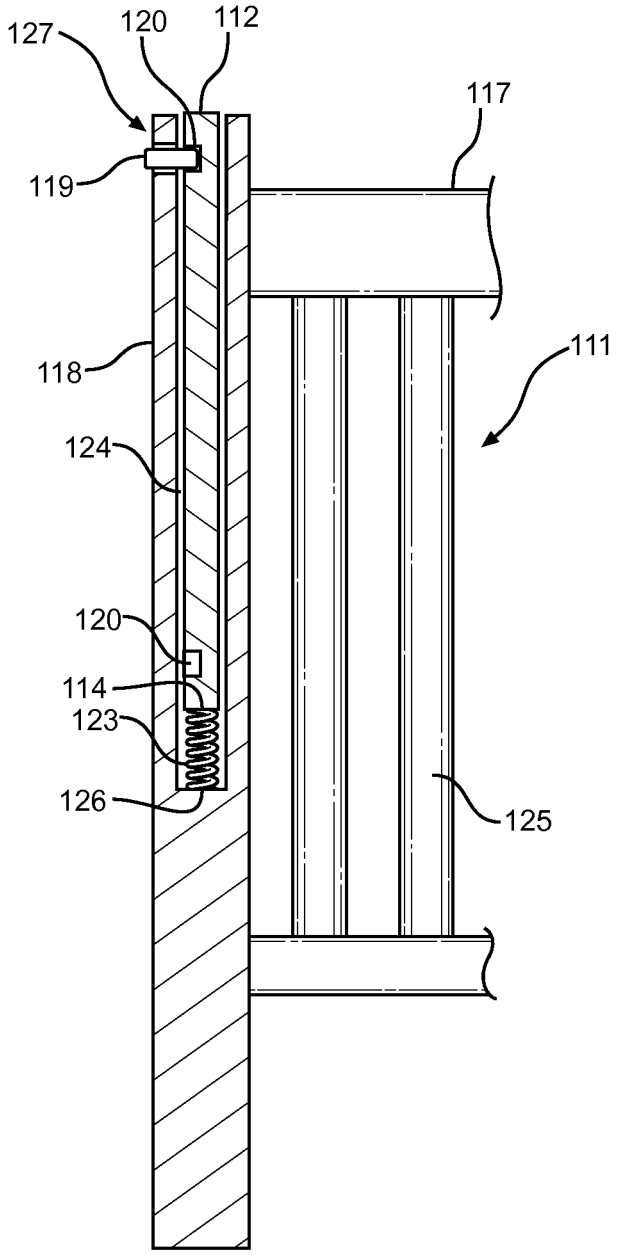
FIG. 4 shows a cross sectional view of an alternate embodiment of the crib of the built-in mobile arm for a crib, wherein the mobile arm is in a stored configuration.

Referring now to FIGS. 3 and 4, there is shown a perspective view of an alternate embodiment of the crib of the built-in mobile arm for a crib, wherein the mobile arm is in a working configuration and a cross sectional view of an alternate embodiment of the crib of the built-in mobile arm for a crib, wherein the mobile arm is in a stored configuration, respectively. In the illustrated embodiment of the crib 117, the recessed area 124 is disposed within a leg 118 of the crib 117, rather than on a sidewall 125 thereof. In a stored configuration, the recessed area 124 is adapted to receive the mobile arm 112 therein, whereas in the working configuration the mobile arm 112 extends upwards from the recessed area 124.

Preferably, the crib 117 comprises a spring 123 having a first end and a second end, wherein the first end is secured to a lower end 126 of the recessed area 124 and the second end of the spring 123 is secured to the second end 114 of the mobile arm 112. The spring 123 is configured to expand in order to push the mobile arm 112 towards the open upper end of the crib 117 and compress in order to allow the mobile arm 112 to retract within the recessed area 124 for storing.

Preferably, the crib 117 further comprises a locking mechanism 127 adapted to prevent the spring 123 from expanding, thereby preventing the mobile arm 112 from extending from the recessed area 124 while disposed in the stored configuration. In the illustrated embodiment, the locking mechanism 127 comprises a spring-loaded button 119 that extends through a side of the leg 118 and engages the mobile arm 112. However, in other embodiments, any suitable button or peg can be used that prevents the mobile arm 112 from extending from the recessed area 124 in the stored configuration, such as a locking push pin.

In the illustrated embodiment, the locking mechanism 127 further comprises one or more slots 120 disposed in the mobile arm 112 adapted to receive the spring-loaded button 119 therein. A first slot 120 disposed on the mobile arm 112 is adapted to align with the spring-loaded button 119 is the stored configuration and a second slot 120 is adapted to align with the spring-loaded button 119 in the working configuration. Thus, the mobile arm 112 remains extended or retracted as the user desires by actuating the button 119 and engaging the slot 120.

In the stored configuration, the mobile arm 112 is vertically disposed within the recessed area 124 of the crib 117, wherein the locking mechanism 127 prevents the arm 112 from extending upwards via the spring 123. In embodiments having more than one elongated member 128, the members 128, 129 are pivoted parallel to one another prior to insertion within the recessed area 124. In the working configuration, the first elongated member 128 of the mobile arm 112 extends substantially horizontally over the upper end of the interior of the crib 117, whereas the second elongated member 129 extends vertically upwards from the upper end of the recessed area 124.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A built-in mobile arm for a crib comprising:

a crib having a base, one or more sidewalls, and an open upper end, defining an interior volume;

a mobile arm having a first end and a second end, wherein said second end is adjustably secured to said crib;

wherein said first end of said mobile arm is configured to receive a mobile thereon;

said crib comprising a recessed area disposed thereon, wherein said recessed area is configured to receive and store said mobile arm therein;

a spring having a first end secured to a lower end of said recessed area and a second end secured to said second end of said mobile arm, wherein said spring is configured to expand in order to extend said mobile arm from said recessed area and compress in order to retract said mobile arm into said recessed area.

2. The built-in mobile arm for a crib of claim 1, wherein said mobile arm comprises one or more elongated members, wherein a first elongated member is pivotally secured to a second elongated member.

3. The built-in mobile arm for a crib of claim 1, wherein: said recessed area is disposed on said one or more sidewalls.

4. The built-in mobile arm for a crib of claim 3, wherein said mobile arm is adjustably and rotatably secured to said one or more sidewalls on which said recessed area is disposed.

5. The built-in mobile arm for a crib of claim 1, further comprising a locking mechanism having a spring-loaded button horizontally disposed through a leg of said crib and one or more slots disposed on said mobile arm, such that said spring-loaded button engages said one or more slots in order to prevent said mobile arm from moving.

6. The built-in mobile arm for a crib of claim 1, wherein said first end of said mobile arm comprises a hook thereon so as to suspend a mobile therefrom.

7. The built-in mobile arm for a crib of claim 1, wherein the recessed area is disposed in a leg of the crib.

* * * * *